United States Patent [19]

Honda et al.

[11] Patent Number: 4,973,880

[45] Date of Patent: Nov. 27, 1990

[54] SINGLE END-SEALED METAL HALIDE LAMP

[75] Inventors: Kazuo Honda, Hiratsuka; Atsushi Matsuura, Yokohama; Hisanori Sano, Yokosuka, all of Japan

[73] Assignee: Toshiba Lighting & Technology Corporation, Tokyo, Japan

[21] Appl. No.: 356,874

[22] Filed: May 25, 1989

[30] Foreign Application Priority Data

May 27, 1988 [JP] Japan ..... 63-129902
Aug. 5, 1988 [JP] Japan ..... 63-194573
Nov. 28, 1988 [JP] Japan ..... 63-300013

[51] Int. Cl.[5] ..... H01J 17/04; H01J 61/04

[52] U.S. Cl. ..... 313/633; 313/349; 313/350

[58] Field of Search ..... 313/633, 635, 349, 350

[56] References Cited

U.S. PATENT DOCUMENTS 4,320,322 3/1982 Rothwell, Jr. et al. ..... 313/349
4,636,687 1/1987 Keeffe et al. ..... 313/634

FOREIGN PATENT DOCUMENTS 52-15910 5/1977 Japan .
52-54167 3/1984 Japan .
60-232662 11/1985 Japan .

*Primary Examiner*—Sandra L. O'Shea
*Attorney, Agent, or Firm*—Cushman, Darby & Cushman

[57] ABSTRACT

An arc tube bulb comprises a sealed portion formed at one end of the bulb and an enclosure portion formed at the other end to surround a discharge space. A pair of metal foils are buried in the sealed portion. A rare gas for start-up, mercury and a metal halide are charged in the discharged space. A pair of electrodes comprise a pair of electrode rods connected to the metal foils and coils disposed at the tips of the rods. These coils are positioned within the discharge space apart from each other and facing each other. The lamp is lit when the value of the input power WL (watt) divided by the inner surface area S ($cm^2$) of the discharge space falls within the range of between 20 and 70, i.e., $20 \leqq WL/S \leqq 70$. The surface region of the electrode rods is formed of a pure rhenium metal or a rhenium-tungsten alloy. Since the pure rhenium metal or rhenium-tungsten alloy has a low thermal conductivity, the temperature elevation of the electrode rod can be suppressed in the single end-sealed metal halide lamp of the particular construction.

18 Claims, 4 Drawing Sheets

SINGLE END-SEALED METAL HALIDE LAMP

BACKGROUND OF THE INVENTION

1. Field of the Invention

The present invention relates to a single endsealed metal halide lamp, more particularly, to a small metal halide lamp which can be lit with a high load.

2. Description of the Related Art

A high intensity discharge lamp (HID), which was widely used for outdoor illumination or illumination within a factory, has come to be used/recently for the indoor illumination in the architecture where there are low ceilings, such as stores. Among the HID, a metal halide lamp, which is miniaturized, is used in many cases in, for example, stores because the metal halide lamp exhibits a high efficacy and high color rendering properties.

A conventional metal halide lamp is sealed at both ends of an arc tube bulb. Since the bulb is sealed by pinch sealing at both ends, the manufacturing process of the lamp is complex. Also, since the area of the sealed portion is large relative to the entire area of the arc tube bulb, the lamp is rendered bulky as a whole. Further, heat is transmitted to the sealed portion via the wall defining the discharge space, and the heat is released from the sealed portion to the outside. It follows that the conventional metal halide lamp gives rise to a large heat loss.

In order to miniaturize the lamp, it is advantageous to form a sealed portion at one end of a bulb and the discharge space is surrounded by the other end of the bulb, as disclosed in Japanese Patent Disclosure 60-232662. A lamp of this type is low in heat loss because the arc tube bulb is sealed at only one end, leading to an improved light emitting efficiency. Also, the sealing process can be simplified because only a single end of the bulb is sealed. In addition, the single end-sealed type makes it possible to miniaturize the lamp as a whole.

The single end-sealed arc tube bulb comprises a pair of metal foils, e.g., molybdenum foils, buried in one end of the bulb and rod electrodes each having one end connected to the foil. The other end of each rod electrode extends into the discharge space and an electrode coil is mounted to the other end of the rod electrode.

The conventional metal halide lamp of single end-sealed type is lit under a high lamp load, i.e., the value of WL/S falls within the range of between 20 and 70, where WL denotes the lamp input power (W) and S represents the inner surface area ($cm^2$) of the discharge space. In the lamp lit under such a high load, however, the initial blackening of the light emitting bulb is promoted, leading to reduction in the lumen maintenance factor and to a shortened life of the lamp.

In the conventional lamp, each of the electrode, electrode rod and electrode coil is formed of a tungsten wire or a thoriated tungsten ($ThO_2$-W) wire. In the step of mounting a pair of electrodes in the sealed portion at one end of the arc tube bulb, the electrodes connected to the pair of metal foils are inserted into the bulb through one open end of the bulb. Under this condition, the open end of the bulb is softened under heat, followed by pinching under pressure the softened end portion so as to achieve the sealing. It should be noted that the electrode rods are positioned relatively close to the wall of the arc tube bulb in the case of inserting two electrodes into the bulb, compared with the case of inserting a single electrode rod. Thus, in the step of softening the open end portion of the bulb under heat, the two electrode rods are heated to a high temperature by the bulb wall, leading to oxidation of the electrode rods. When oxidized, the material of the electrode rod tends to be scattered. The scattered electrode material is attached to the inner surface of the bulb and, thus, the bulb wall is blackened. Since the surface area of the arc tube bulb is small in a lamp of this type, the blackening proceeds promptly in a short time, even if the electrode material is scattered only in a small amount, resulting in a marked reduction in the lumen maintenance factor.

The conventional electrode formed of tungsten or thoriated tungsten has a relatively high heat conductivity. Thus, heat is conducted to reach the proximal end portion of the electrode rod during the lighting of the lamp, leading to heating to a high temperature. In addition, since the bulb is small and sealed at one end alone, the distance is small between the proximal end portions of the pair of the electrode rods. In conjunction with the heating to a high temperature noted above, the construction noted above causes the arc spot to be moved to a space between the proximal end portions of the electrode rods, with the result that discharge is likely to take place easily between the electrode rods. Such a discharge causes the material of the electrode rod to be scattered, leading to breakage of the electrode rod and to a short life of the lamp.

On the other hand, an arc spot is formed during the lighting between a pair of coils disposed to face each other within the discharge space so as to generate an arc discharge between these coils. The arc spot tends to move easily during the lighting of the lamp. The movement of the arc spot causes a change in the distance between the arc and the inner surface of the arc tube bulb. Naturally, changes also take place in the position and temperature of the coolest region of the bulb wall rearward of the electrode coil. As a result, the lamp voltage is changed and the light emitting characteristics are rendered nonuniform. The movement of the arc spot brings about additional problems. For example, the arc is positioned close to inner surface of the arc tube bulb so as to locally heat the light emitting bulb to a high temperature and, thus, to cause a thermal expansion of the bulb.

SUMMARY OF THE INVENTION

An object of the present invention is to provide a metal halide lamp capable of preventing the arc tube bulb from being blackened so as to improve the lumen maintenance factor and also capable of preventing the electrode rod from being broken so as to improve the life of the lamp.

Another object is to provide a metal halide lamp capable of preventing the lamp voltage and light emitting characteristics from being changed even if the arc spot is moved and also capable of preventing the arc tube bulb from being locally expanded thermally so as to improve the life of the lamp.

According to the present invention, there is provided a single end-sealed metal halide lamp, comprising:

an arc tube bulb sealed at one end to form a sealed portion and having an enclosure portion formed at the other end, the enclosure portion surrounding a discharge space in which a starting rare gas is charged and mercury and a metal halide are received;

a pair of metal foils buried in the sealed portion; and a pair of electrode means each including a rod and a coil disposed at the tip of the rod, said coils being disposed a predetermined distance apart from each other in a manner to face each other within the discharge space, and the rods extending into the sealed portion so as to be connected to the metal foils;

wherein said lamp is lit when the value of the input power WL (watt) divided by the inner surface area S ($cm^2$) of the discharge space falls within the range of between 20 and 70, i.e., $20 \leqq WL/S \leqq 70$, and at least the surface layer of the electrode rod is formed of a pure rhenium metal or a rhenium-tungsten alloy.

In the present invention, at least the surface layer of the electrode rod is formed of a pure rhenium metal or a rhenium-tungsten alloy. It should be noted in this connection that tungsten is oxidized at about 300° to 500° C. On the other hand, rhenium cannot be oxidized at about 1000° C. Also, the thermal conductivity of rhenium is smaller than that of tungsten. To be more specific, rhenium has a thermal conductivity of about 0.095 [cal/(sec. ($cm^2$).(° C/cm)]in contrast to 0.4 [cal/(sec. ($cm^2$).(° C./cm)]for tungsten. It follows that the metal halide lamp according to the first embodiment of the present invention is low in the thermal conductivity of the electrode rod, compared with the prior art, making it possible to suppress the temperature elevation of the electrode rod. As a result, the electrode rod material is unlikely to be scattered so as to be attached to the inner surface of the arc tube bulb during the lighting of the lamp. Naturally, it is possible to suppress the blackening of the bulb. It should also be noted that, since the temperature elevation on the surface of the electrode rod is suppressed during the lighting of the lamp, it is possible to prevent the occurrence of discharge between the proximal end portions of the rods. As a result, it is possible to suppress the breakage of the electrode rod, leading to a high lumen maintenance factor and to a long life of the lamp.

Also, according to the present invention, there is provided a single end-sealed metal halide lamp, comprising:

an arc tube bulb sealed at one end to form a sealed portion and having, an enclosure portion formed at the other end, the enclosure portion surrounding a discharge space in which a starting rare gas is charged and mercury and a metal halide are received;

a pair of metal foils buried in the sealed portion; and a pair of electrode means each including a rod and a coil disposed at the tip of the rod, said coils being disposed a predetermined distance apart from each other in a manner to face; each other within the discharge space, and the rods extending into the sealed region so as to be connected to the metal foils;

wherein said lamp is lit when the value of the input power WL (watt) divided by the inner surface area S ($cm^2$) of the discharge space falls within the range of between 20 and 70, i.e., $20 \leqq WL/S \leqq 70$, and the relationship between the electrode coil and the discharge space meets the condition of $d3/D \leqq 0.2$, where d3 is an outer diameter (mm) of the electrode coil and D is a maximum inner diameter (mm) of the discharge space in a direction perpendicular to the arc in the center of the light emitting position.

In the lamp of the second embodiment, the inner diameter of the arc tube bulb is relatively large, compared with the outer diameter of the electrode coil. Thus, even if the arc spot is moved on the surface of the coil, the bulb is less likely to be heated by the arc after the arc has been moved sufficiently apart from the bulb wall. This makes it possible to prevent the coolest point formed on the bulb wall from being changed. As a result, it is possible to suppress the change in the lamp voltage and the light emitting characteristics of the lamp. It is also possible to prevent the arc tube bulb from being locally swollen. These combine to improve the life of the lamp.

DETAILED DESCRIPTION OF THE PREFERRED EMBODIMENT

Figure 1:
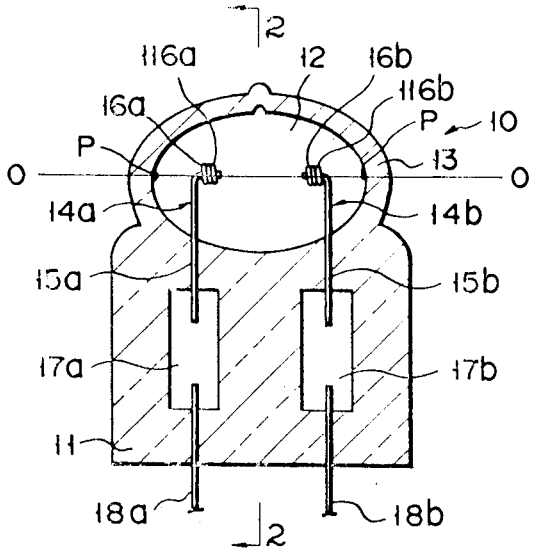
FIG. 1 is a vertical cross sectional view showing an arc tube bulb included in the lamp according to a first embodiment of the present invention.
Figure 2:
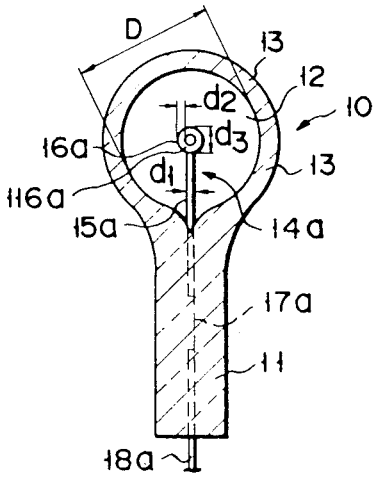
FIG. 2 is cross sectional view along line 2—12 of FIG. 1.

FIGS. 1 and 2 collectively show an arc tube bulb of a metal halide lamp according to a first embodiment of the present invention. The lamp has an input power of 150 W. A reference numeral 10 shown in the drawing denotes an arc tube bulb formed of a quartz glass. A sealed portion 11 is formed by pinch sealing at only one end of the arc tube bulb 10, with an enclosure portion 13 defining a discharge space 12 being formed at the other end of the bulb. The enclosure portion 13 is in the shape of a somewhat deformed sphere and, thus, looks oblong or circular depending on the viewing angle. The discharge space 12 defined by the enclosure portion has an inner volume of 0.5 cc. A bulb axis O—-O extends along the longer axis of the oblong enclosure portion 13, and the sealed portion 11 is formed at one end of the bulb 10 in a direction perpendicular to the bulb axis O—O. The sealed portion 11 is formed by pinching and, thus, has flat surfaces. A pair of electrodes **14*a*, 14*b* are arranged apart from each other along the bulb axis O—O within the bulb 10. Each of these electrodes 14*a*, 14*b* is sealed in the sealed portion 11 formed by pinching. These electrodes comprise electrode rods 15*a*, 15*b*, and electrode coils 16*a*, 16*b* mounted at the tips of the electrodes 15*a* and 15*b*, respectively. In the embodiment shown in FIGS. 1 and 2, the rods 15*a*, 15*b* are formed separately from the coils 16*a*, 16*b*. It should be noted that each of these rods 15*a* and 15*b* is formed of a pure rhenium metal or a rhenium-tungsten alloy and is bent at the tip portion. Each of the coils 16*a*, 16*b* is formed by winding wires 116*a*, 116*b*** each consisting of a pure tungsten or thoriated tungsten. The tungsten or thoriated tungsten wire is wound 3 or 4 turns about the bent tip portion of the electrode rod so as to form the coil.

It is desirable to use a pure rhenium wire having a diameter of 0.5 mm for forming the rod 15*a* or 15*b*. It is also desirable to use a thoriated tungsten wire having a diameter of 0.5 mm for forming the coils 16*a*, 16*b*. Thus, in the embodiment shown in FIGS. 1 and 2, each of the coils 16*a*, 16*b* has an outer diameter d3 of 1.5 mm. It should be noted that the coils 16*a*, 16*b* are apart from each other by about 6.8 mm within the discharge space along the bulb axis O—O.

Metal foils 17*a*, 17*b* formed of, for example, molybdenum are buried apart from each other within the sealed portion 11 formed by pinching. The rods 15*a*, 15*b*, which are positioned apart from each other by a distance greater than the distance between the tips of the coils 16*a*, 16*b*, are connected at the proximal ends to the metal foils 17*a*, 17*b*, respectively. Further, the metal foils 17*a*, 17*b* are respectively connected to outer lead wires 18*a*, 18*b* extending to the outside. Still further, a starter rare gas, a predetermined amount of mercury and a metal halide such as $SnI_2$, NaI, TlI, InI, NaBr or LiBr are sealed in the bulb 10.

In the present invention, the relationship between the maximum inner diameter of the discharge space 12 and the outer diameter of the coil 16*a* or 16*b* is determined to meet the condition given below:

$$d3/D \leqq 0.2 \quad \ldots (1)$$

where, D is the maximum inner diameter of the arc tube bulb 10 in the discharge space 12 in a direction perpendicular to the arc in the center of the light emitting region, i.e., in the center between the pair of coils 16*a*, 16*b*, and d3 is the outer diameter of the coil 16*a* or 16*b*.

Where, for example, the maximum inner diameter of the arc tube bulb 10 is 13 mm, the value of d3/D 0.115 or less.

In the single end-sealed metal halide lamp of the construction described above, the lamp current during the stable lighting stage is set at 1.8 A, and the input power of the lamp in this stage is set at 150 W. It should also be noted that the inner surface area S of the discharge space 12 is about 3.5 $cm^2$, and the lamp load per unit surface area of the light emitting bulb is about 43 $W/cm^2$. The value of the lamp load given above is about twice the lamp load of the conventional metal halide lamp sealed at both ends.

The single end-sealed metal halide lamp of the construction shown in FIGS. 1 and 2 produces prominent effects. As described previously, each of the rods 15*a*, 15*b* of the electrodes 14*a*, 14*b* is formed of a pure rhenium wire. Since rhenium is oxidized at a high temperature, the rods 15*a*, 15*b* are less likely to be oxidized when heated for softening the bulb 10 in the step of forming the sealed portion 11 by pinching. As a result, the material of these rods is less likely to be scattered so as to be attached to the inner surface of the enclosure portion 13, leading to a high lumen maintenance factor of the lamp.

It should also be noted that the rods 15*a*, 15*b* formed of rhenium serve to suppress the heat conduction from the coils 16*a*, 16*b* to these rods. Naturally, the temperature elevation of these rods is suppressed during the lighting of the lamp, with the result that the arc spot is not transferred to a space between these rods 15*a* and 15*b*. It follows that it is possible to prevent the discharge occurrence between the rods and, thus, to prevent these rods from being thinned and finally being broken. Since the rods 15*a*, 15*b* are not broken, the life of the lamp is prolonged.

It is desirable to set the diameter d1 (mm) of the rods 15*a*, 15*b* to meet the condition given below:

$$2.4 \leqq I/d1 \leqq 4.5 \quad \ldots (2)$$

where, d1 is the diameter of the rods 15*a*, 15*b*, and I is the lamp current during the stable lighting of the lamp.

In the embodiment, the value of I/d1 is 3.6.

If the rod has a large diameter d1, the heat capacity of the rod is increased, making it possible to suppress the temperature elevation of the rod. As a result, the scattering of the rod material and the thinning of the rod can be prevented, leading to a high lumen maintenance factor. In addition, since it is possible to prevent the rod from being broken, the life of the lamp can be prolonged. However, if the diameter d1 of the rod is unduly large, the electrode temperature is excessively lowered, resulting in an abrupt interruption of lighting. In addition, the halogen cycle is impaired. To overcome this difficulty, the present inventors have made an extensive research so as to find that it is desirable for the relationship between the diameter d1 (mm) of the rods 15*a*, 15*b* and the lamp current I (amperes) during the stable lighting of the lamp to meet the condition $2.4 \leqq I/d1 \leqq 4.5$. This is the case with not only a metal halide lamp having an input power of 150 W but also lamps of other rated input power.

In the present invention, it is also desirable to set the diameter d1 (mm) of the rods 15*a*, 15*b* and the diameter d2 (mm) of the wire 116*a*, 116*b* which forms the coils 16*a*, 16*b* to meet the condition given below:

$$0.3 \leqq d2/d1 \leqq 1 \quad \ldots (3)$$

If the diameter d2 of the wire forming the coils 16*a*, 16*b* is large, the heat capacity of the coils is increased so as to suppress the temperature elevation of the coils. As a result, the arc spot is unlikely to be generated on the coils. It follows that it is possible to maintain a stable discharge, if the diameter d2 of the wire forming the coils is made equal to or smaller than the diameter d1 of the rods 15*a*, 15*b* so as to meet the condition given above, i.e., $0.3 \leqq d2/d1 \leqq 1$.

What should also be noted is that the relationship between the maximum diameter D of the arc tube bulb 10 in the discharge space 12 in a direction perpendicular to the arc in the light emitting center and the outer diameter d3 of the coils 16*a*, 16*b* is defined to meet the condition "$d3/D \leqq 0.2$" in the present invention, as pointed out previously. In other words, the arc generated between the coils 16*a* and 16*b* is positioned a large distance apart from the inner wall of the arc tube bulb 10 in the present invention, with the result that, even if the arc spot is moved on the surfaces of the coils 16*a*, 16*b*, it is possible to suppress the heating of the arc tube bulb 10 caused by the heat of the arc. Further, the coolest portions are formed in the arc tube bulb 10 at points P, P rearward of the electrode coils 16*a*, 16*b* which are positioned far apart from the arc. What should be noted is that the coolest portions P, P are not moved even if the arc is moved, with the result that the temperature of the coolest points is not changed so as to suppress the changes in the lamp voltage and in the light emitting characteristics. Still further, the wall of the arc tube bulb 10 is not locally heated by the arc so as to prevent the local thermal expansion of the bulb wall.

Figure 3:
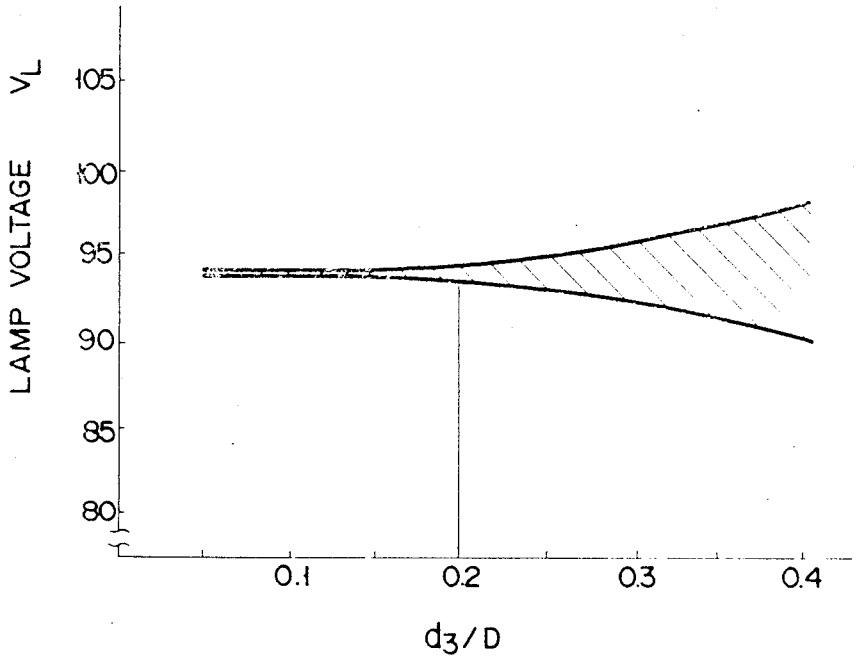
FIG. 3 is a graph showing the change in the lamp voltage with respect to the ratio of the electrode coil diameter to the inner diameter of the discharge space.

The condition of d3/D≦0.2, which is defined in the present invention with respect to the outer diameter d3 of the coils 16*a*, 16*b* and the maximum inner diameter D in the light emitting center of the discharge space 12, has been experimentally determined by the present inventors. Specifically, FIG. 3 is a graph showing the changes in the lamp voltage $V_L$ relative to the change in the ratio of the coil outer diameter d3 to the maximum inner diameter D of the discharge space, i.e., $V_L$ vs d3/D. The range of variation represented by the shaded region in the graph of FIG. 3 denotes the average value of the deviation resulting from 10 measurements. It is seen that the range of variation is increased with increase in the value of d3/D.

Table 1 below shows experimental data on the relationship between the ratio d3/D and the swelling of the light emitting bulb 10:

TABLE 1

| | Lighting Time (Hours) | | | | |
|---|---|---|---|---|---|
| d3/D | 0 | 1000 | 2000 | 3000 | 6000 |
| 0.05 | no swelling | no swelling | no swelling | no swelling | no swelling |
| 0.10 | no swelling | no swelling | no swelling | no swelling | no swelling |
| 0.20 | no swelling | no swelling | no swelling | no swelling | no swelling |
| 0.25 | no swelling | no swelling | no swelling | no swelling | swollen |
| 0.30 | no swelling | no swelling | no swelling | swollen | swollen |
| 0.40 | no swelling | swollen | swollen | swollen | swollen |

As is apparent from Table 1, swelling is caused by the heating during the life of the lamp where the ratio d3/D is greater than 0.2. In other words, it is possible to prevent the bulb from being swollen during the life of the lamp if the ratio of the outer diameter d3 of the electrode coil to the maximum inner diameter D of the discharge space, i.e., the value of d3/D, is set at 0.2 or less.

In the embodiment described above, the electrode rods 15*a*, 15*b* are formed of a pure rhenium. Alternatively, it is possible to use a rhenium-tungsten alloy as a material of these rods. Even in this case, the present invention produces prominent effects, compared with the prior art in which the electrode rod is formed of a pure tungsten or thoriated tungsten. In the case of using a rhenium-tungsten alloy, the mixing ratio of rhenium to tungsten (Re/W) should be 0.05 or more by weight. If the Re/W ratio is smaller than 0.05, the rhenium amount is insufficient for achieving the object of the rhenium addition. In other words, the electrode material tends to be scattered and the electrode rod is likely to be thinned, resulting in reduction in the lumen maintenance factor. In addition, the electrode rod tends to be broken, leading to a short life of the lamp.

Table 2 shows the experimental data on the effect of the Re/W mixing ratio:

TABLE 2

| Re/W Mixing Ratio | Electrode Breakage Occurrence after 3000 hrs | Electrode Breakage Occurrence after 6000 hrs | Evaluation |
|---|---|---|---|
| 0.01 | 4/10 | 8/10 | x |
| 0.03 | 0/10 | 2/10 | x |
| 0.05 | 0/10 | 0/10 | good |
| 0.1 | 0/10 | 0/10 | good |

TABLE 2-continued

| Re/W Mixing Ratio | Electrode Breakage Occurrence after 3000 hrs | Electrode Breakage Occurrence after 6000 hrs | Evaluation |
|---|---|---|---|
| 0.1 | 0/10 | 0/10 | good |
| 0.3 | 0/10 | 0/10 | good |

Note:
x . . . impossible to evaluate

As apparent from Table 2, it is desirable to set the ratio Re/W of the rhenium-tungsten alloy at 0.05 or more. It is more desirable to set the ratio Re/W at 0.1 or more and to set the upper limit of the ratio at 0.5. A ratio higher than 0.5 is not desirable in terms of the manufacturing cost of the alloy because rhenium is costly.

Figure 4:
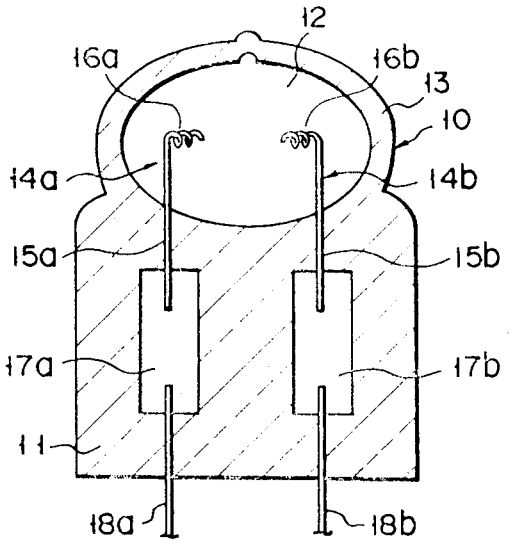
FIG. 4 is a vertical cross sectional view showing an arc tube bulb included in the lamp according to a second embodiment of the present invention.

FIG. 4 shows a second embodiment of the present invention. The second embodiment differs from the first embodiment shown in FIGS. 1 and 2 in that the coils 16*a*, 16*b* are integral with the rods 15*a*, 15*b* so as to form the electrodes 14*a*, 14*b*, respectively. In the second embodiment, the integral structure of the coil and the rod is formed of a pure rhenium metal or a rhenium-tungsten alloy. Of course, the effects produced by the first embodiment are also produced by the second embodiment. In addition, the coils 16*a*, 16*b* are prevented from being excessively heated during the lighting of the lamp in the second embodiment, making it possible to suppress the heat conduction from the coils 16*a*, 16*b* to the rods 15*a*, 15*b*. As a result, it is possible to prevent the temperature elevation of the rods 15*a*, 15*b*.

Figure 5:
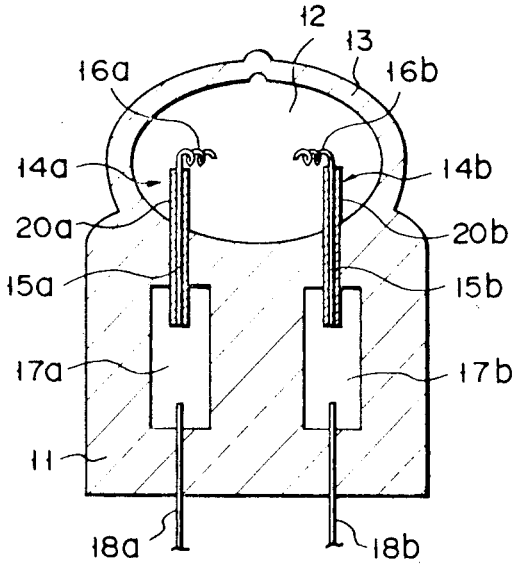
FIG. 5 is a vertical cross sectional view showing an arc tube bulb included in the lamp according to a third embodiment of the present invention.

FIG. 5 shows a third embodiment of the present invention. The third embodiment differs from the first embodiment in that the coils 16*a*, 16*b* are integral with the rods 15*a*, 15*b* so as to form the electrodes 14*a*, 14*b*, respectively, and that the integral structure of the coil and the rod is formed of a pure tungsten metal or a thoriated tungsten. In the third embodiment, however, the rods 15*a*, 15*b* are covered with tubes 20*a*, 20*b*, respectively, said tubes being formed of a pure rhenium metal or a rhenium-tungsten alloy.

In the step of sealing one end of the arc tube bulb 10, the electrodes 14*a*, 14*b* are inserted into the bulb through the open end of the bulb which has not yet been sealed, and the rods 15*a*, 15*b* are heated. In the construction shown in FIG. 5, however, the rods 15*a*, 15*b*, which are formed of tungsten, are not oxidized even if these rods are heated because these rods are covered with the tubes 20*a*, 20*b* formed of a pure rhenium metal or a rhenium-tungsten alloy. Of course, the tubes 20*a*, 20*b* are not oxidized either because a pure rhenium metal or a rhenium-tungsten alloy is unlikely to be oxidized. It follows that the scattering of the materials of the rods 15*a*, 15*b* and the tubes 20*a*, 20*b* is suppressed during the lighting of the lamp so as to prevent the blackening of the bulb and, thus, to improve the lumen maintenance factor. Incidentally, it is possible to cover the surfaces of the rods 15*a*, 15*b* with a film of a pure rhenium metal or a rhenium-tungsten alloy in place of covering the rods with the tubes 20*a*, 20*b*. The covering film noted above can be formed by means of plating, coating of a powdery material or the like.

Figure 6:
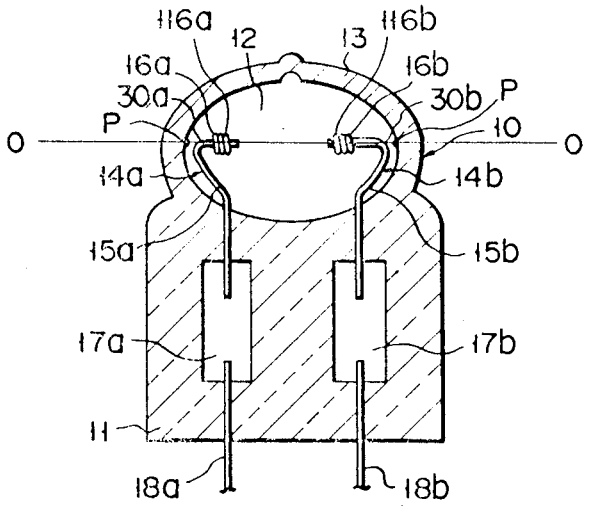
FIG. 6 is a vertical cross sectional view showing an arc tube bulb included in the lamp according to a fourth embodiment of the present invention.

FIG. 6 shows a fourth embodiment of the present invention. The fourth embodiment differs from the first embodiment shown in FIGS. 1 and 2 in that the pair of electrode rods 15*a*, 15*b* are bent backward at the point where these rods extending from the sealed portion 11 enter the discharge space 12. As seen from the drawing, the rods 15*a*, 15*b* are bent such that the pair of coils 16*a*, 16*b* are moved away from each other and these rods extend along the inner surface of the enclosure portion 13. Since the rods 15*a*, 15*b* are bent in a manner to extend along the inner surface of the bulb 10, the bent portions 30*a*, 30*b* of the rods 15*a*, 15*b* are positioned close to those portions of the bulb wall which are positioned on the bulb axis O—O. As a result, the bulb wall is warmed by the heat of radiation emitted from the bent portions 30*a*, 30*b* of the rods 15*a*, 15*b*. It follows that the coolest portions P, P facing the bent portions 30*a*, 30*b* are warmed, with the result that the vapor pressure within the discharge space 12 is increased so as to improve the light emitting efficacy and the color rendering properties of the lamp. It should also be noted that the coils 16*a*, 16*b* are positioned sufficiently apart from each other in the fourth embodiment shown in FIG. 6 because the rods 15*a*, 5*b* are bent in a manner to extend along the inner surface of the bulb 10. This is effective in that, even if the bulb 10 is small, it is possible to provide a large free space between the electrodes. In other words, it is possible to ensure a large arc length, leading to an improved light emitting efficacy.

Figure 7:
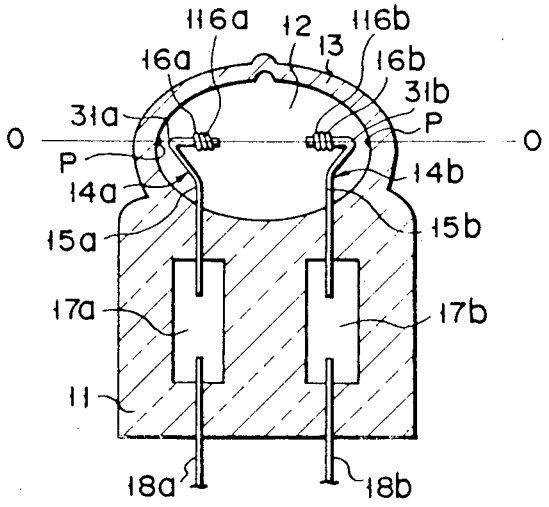
FIG. 7 is a vertical cross sectional view showing an arc tube bulb included in the lamp according to a fifth embodiment of the present invention.

FIG. 7 shows a fifth embodiment of the present invention. The fifth embodiment, which is a modification of the fourth embodiment shown in FIG. 6, differs from the fourth embodiment in that, in the fifth embodiment, the rods 15*a*, 15*b* are bent such that only the portions 31*a*, 31*b* rearward of the coils 16*a*, 16*b* are positioned close to the bulb wall, though the rods are bent in the fourth embodiment shown in FIG. 6 such that the rods extend along the inner surface of the bulb 10. Incidentally, each of the rods and the coils may be formed of a single wire material so as to provide the electrode 14 of an integral structure in each of the embodiments of FIGS. 6 and 7.

As described previously, the input power WL (watt) of the lamp divided by the inner surface area S ($cm^2$) of the discharge space 12, i.e., the value of WL/S, is defined to fall within the range of between 20 and 70 $W/cm^2$ in the present invention. Particularly, it is desirable for the value of WL/S to fall within the range of between 20 and 50 $W/cm^2$.

What is claimed is:

1. A single end-sealed metal halide lamp of a rated input power WL (watt), comprising:

an arc tube bulb sealed at one end and having an enclosure portion formed at another end, said enclosure portion surrounding a discharge space in which a starting rare gas is charged and mercury and a metal halide are received, said arc tube bulb being lit when the value of the input power WL (watt) divided by an inner surface area S ($cm^2$) of the discharge space falls within the range of from 20 to 70, i.e., $20 \leqq WL/S \leqq 70$;

a pair of metal foils buried in the sealed portion; and a pair of electrode means each including a rod and a coil disposed at the tip of the rod, said coils being disposed at predetermined distance apart from each other in a manner so as to face each other within the discharge space, said rods extending into the sealed region so as to be connected to the metal foils, and at least the surface layer of the electrode rod being formed of a pure rhenium metal or a rhenium-tungsten alloy having a Re/W weight ratio of at least 0.05.

2. The single end-sealed metal halide lamp as claimed in claim 1, wherein the entire electrode rod is formed of a pure rhenium metal or a rhenium-tungsten alloy having a Re/W weight ratio of at least 0.05.

3. The single end-sealed metal halide lamp as claimed in claim 1, wherein said coil being formed of a wire, the outer diameter d1 (mm) of the electrode rod and the outer diameter d2 (mm) of the wire are determined to meet the condition of $0.3 \leqq d2/d1 \leqq 1$.

4. The single end-sealed metal halide lamp as claimed in claim 3, wherein the pair of electrode rods are bent such that the distance between intermediate portions, which are located between tip end portions and proximal end portions, is larger than the distance between the proximal end portions, and that the bent intermediate portions are positioned close to the inner surface of the enclosure portion.

5. The single end-sealed metal halide lamp as claimed in claim 1, wherein the lamp current I (amperes) and the outer diameter d1 (mm) of the electrode rod are determined to meet the condition of $2.4 \leqq I/d1 \leqq 4.5$.

6. The single end-sealed metal halide lamp as claimed in claim 1, wherein the metal halide is at least one compound selected from the group essentially consisting of $SnI_2$, NaI, TlI, InI, NaBr and LiBr.

7. A single end-sealed metal halide lamp of a rated input power WL (watt), comprising:

an arc tube bulb sealed at one end and having an enclosure portion formed at the other end, said enclosure portion surrounding a discharge space in which a starting rare gas is charged and mercury and a metal halide are received, said arc tube bulb being lit when the value of the input power WL (watt) divided by the inner surface area S ($cm^2$) of the discharge space falls within the range of between 20 and 70, i.e., $20 \leqq WL/S \leqq 70$;

a pair of metal foils buried in the sealed portion; and a pair of electrode means each including a rod and a coil disposed at the tip of the rod, said coils being disposed a predetermined distance apart from each other in a manner to face each other within the discharge space, and said rods extending into the sealed region so as to be connected to the metal foils;

wherein, the outer diameter d3 (mm) of the electrode coil and the maximum inner diameter D (mm) of the discharge space in a direction perpendicular to the arc in the center of the light emitting region are determined to meet the condition $d3/D \leqq 0.2$.

8. The single end-sealed metal halide lamp as claimed in claim 7, wherein said coil being formed of a wire, the outer diameter d1 (mm) of the electrode rod and the outer diameter d2 (mm) of the wire are determined to meet the condition of $0.3 \leqq d2/d1 \leqq 1$.

9. The single end-sealed metal halide lamp as claimed in claim 8, wherein the pair of electrode rods are bent such that the distance between intermediate portions, which are located between tip end portions and proximal end portions, is larger than the distance between the proximal end portions, and that the bent intermediate portions are positioned close to the inner surface of the enclosure portion.

10. The single end-sealed metal halide lamp as claimed in claim 7, wherein the lamp current I (amperes) and the outer diameter d1 (mm) of the electrode rod are determined to meet the condition of $2.4 \leqq I/d1 \leqq 4.5$.

11. The single end-sealed metal halide lamp as claimed in claim 7, wherein the metal halide is at least one compound selected from the group essentially consisting of $SnI_2$, NaI, TlI, InI, NaBr and LiBr.

12. A single end-sealed metal halide lamp of a rating input power WL (watt), comprising:

an arc tube bulb sealed at one end and having an enclosure portion formed at another end, said enclosure portion surrounding a discharge space in which a starting rare gas is charged and mercury and a metal halide are received, said arc tube bulb being lit when a value of the input lower WL (watt) divided by an inner space area S($cm^2$) of the discharge space falls within the range from 20 to 70i.e., $20 \leqq WL/S \leqq 70$;

a pair of metal foils buried in the sealed portion; and a pair of electrode means each including a rod and a coil disposed at the tip of the rod, said coils being formed of a wire and disposed a predetermined distance apart from one another in a manner so as to face each other within the discharge space, said rods extending into the sealed region so as to be connected to the metal foils, at least the surface layer of the electrode rod being formed of a pure rhenium metal or a rhenium-tungsten alloy, and wherein the outer diameter d1 (mm) of the electrode rod and the outer diameter d2 (mm) of the wire are determined to meet the condition of $0.3 \leqq d2/d1 \leqq 1$.

13. The single end-sealed metal halide lamp as claimed in claim 12, wherein the entire electrode rod is formed of a pure rhenium metal or a rhenium-tungsten alloy.

14. The single-end sealed metal halide lamp as claimed in claim 12, wherein the pair of the electrode rods are bent such that the distance between intermediate portions, which are located between tip end portions and proximal end portions, is larger than the distance between the proximal end portions, and that the bent intermediate portions are positioned close to the inner surface of the enclosed portion.

15. The single-end sealed metal halide lamp as claimed in claim 12, wherein the metal halide is at least one compound selected from the group consisting of $SnI_2$, NaI, TiI, InI, NaBr and LiBr.

16. A single end-sealed metal halide lamp of a rated input power WL (watt), comprising:

an arc tube bulb sealed at one end and having an enclosure portion formed at another end, said enclosure portion surrounding a discharge space in which a starting rare gas is charged and mercury and a metal halide are received, said arc tube bulb being it when a value of the input power WL (watt) divided by a value of an inner space area S ($cm^2$) of the discharge space falls within the range from 20 to 70, i.e., $20 \leqq Wl/S \leqq 70$;

a pair of metal foils buried in the sealed portion; and a pair of electrode means each including a rod and a coil disposed at the tip of the rod, said coils being formed of a wire and disposed a predetermined distance apart from each other in a manner to face each other within the discharge space, said rods extending into the sealed region so as to be connected to the metal foils, at least the surface layer of the electrode rod being formed of a pure rhenium or rhenium-tungsten alloy, and wherein the lamp current I (amperes) and the outer diameter d1 (mm) of the electrode rod are determined so as to meet the condition of $2.4 \leqq I/d1 \leqq 4.5$.

17. The single end-sealed metal halide lamp as claimed in claim 16, wherein the entire electrode rod is formed of a pure rhenium metal or a rhenium-tungsten alloy.

18. The single end-sealed metal halide lamp as claimed in claim 16, wherein the metal halide is at least one compound selected from the group consisting of $SnI_2$, NaI, TiI, InI, NaBr and LiBr.

* * * * *